US009569918B2

(12) United States Patent
Inukai

(10) Patent No.: US 9,569,918 B2
(45) Date of Patent: Feb. 14, 2017

(54) COMPUTER AND METHOD FOR GAME CONTROL

(71) Applicant: GREE, Inc., Minato-ku (JP)

(72) Inventor: Toshitaka Inukai, Tokyo (JP)

(73) Assignee: GREE, Inc., Minato-ku (JP)

( * ) Notice: Subject to any disclaimer, the term of this patent is extended or adjusted under 35 U.S.C. 154(b) by 120 days.

(21) Appl. No.: 14/248,551

(22) Filed: Apr. 9, 2014

(65) Prior Publication Data

US 2014/0309026 A1 Oct. 16, 2014

(30) Foreign Application Priority Data

Apr. 16, 2013 (JP) ..... 2013-086015
Jan. 27, 2014 (JP) ..... 2014-012542

(51) Int. Cl.
*G07F 17/32* (2006.01)

(52) U.S. Cl.
CPC ..... *G07F 17/3218* (2013.01); *G07F 17/329* (2013.01); *G07F 17/3227* (2013.01); *G07F 17/3258* (2013.01); *G07F 17/3281* (2013.01)

(58) Field of Classification Search
None
See application file for complete search history.

(56) References Cited

U.S. PATENT DOCUMENTS

2007/0298874 A1* 12/2007 Baerlocher ..... G07F 17/32 463/27
2008/0108430 A1* 5/2008 Evans ..... G07F 17/3258 463/27
2011/0212762 A1* 9/2011 Ocko ..... G06Q 10/10 463/25
2014/0278853 A1* 9/2014 Brown ..... G06Q 30/0209 705/14.12

FOREIGN PATENT DOCUMENTS

JP 2003-17027 9/2003
JP 2004-23216 11/2004
JP 2007-75592 3/2007

OTHER PUBLICATIONS

Japanese Office Action issued Feb. 25, 2014, in Japan Patent Application No. 2014-012542 (with English translation).

* cited by examiner

*Primary Examiner* — Jason Skaarup
(74) *Attorney, Agent, or Firm* — Oblon, McClelland, Maier & Neustadt, L.L.P.

(57) ABSTRACT

A server apparatus provides a game which accompanies a resource increasing or decreasing in a game space to a plurality of terminal apparatuses via a network. The server apparatus collects and accumulates the resources from the plurality of terminal apparatuses in the first mode and releases the accumulated resource in the second mode. The server apparatus selectively switches between the first mode and the second mode so as to distribute the resources upon reception of a request from a terminal apparatus.

18 Claims, 5 Drawing Sheets

COMPUTER AND METHOD FOR GAME CONTROL

CROSS-REFERENCE TO RELATED APPLICATIONS

Japanese Patent Applications No. 2013-086015, filed on Apr. 16, 2013; and No. 2014-012542, filed on Jan. 27, 2014, the entire contents of all of which are incorporated herein by reference.

BACKGROUND OF THE INVENTION

1. Field of the Invention

The present invention relates to a computer and method for game control suitable for allowing a large number of users to participate in a game via a network.

2. Description of the Related Art

As a game apparatus for allowing users to play games using a plurality of pockets, such as roulette and bingo games, there is proposed a game apparatus including a play compensation means for compensating for the loss of a player (for example, patent literature 1).

CITATION LIST

[Patent Literature 1] Jpn. Pat. Appln. KOKAI Publication No. 2007-075592

A technique described in the above patent literature aims at a game, a type of which allows a user to gamble for coins and the like in a game space and enjoy that the user wins or loses a bet.

There are also available games such as strategy simulation and role playing games, types of which have a character serving as a protagonist, a historical background, and a certain plot. In this game field, when resources (for example, bets, points, and units) on the user side are lost, some of the lost resources are simply returned to users, as in the technique described in the above patent literature, resulting in a monotonous game progress and a lack in entertainment. The validity of the values of the resources to be lost may be questioned depending on situations.

In the field of games such as strategy simulation games, there is groped a technique for appropriately circulating user resources in a game to enhance the degree of entertainment and user motivation for the game.

The present invention has been made in consideration of the above situation and has, as its object, to provide a computer and method for game control capable of imparting a higher degree of entertainment during the resource circulation in a strategy simulation game and the like.

BRIEF SUMMARY OF THE INVENTION

According to an aspect of the present invention, there is provided a computer for providing a game which accompanies a resource increasing or decreasing in a game space to a plurality of terminal apparatuses via a network, comprising:

a resource accumulation unit configured to collect a resource from the plurality of terminal apparatuses and accumulate the collected resource in a first mode;

a resource distribution unit configured to release the accumulated resource and distribute the accumulated resource upon reception of a request from a terminal apparatus in a second mode; and a mode switching unit configured to selectively switch between the first mode and the second mode.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment in which the present invention is applied to an on-line game system will be described below with reference to the accompanying drawing.

Figure 1:
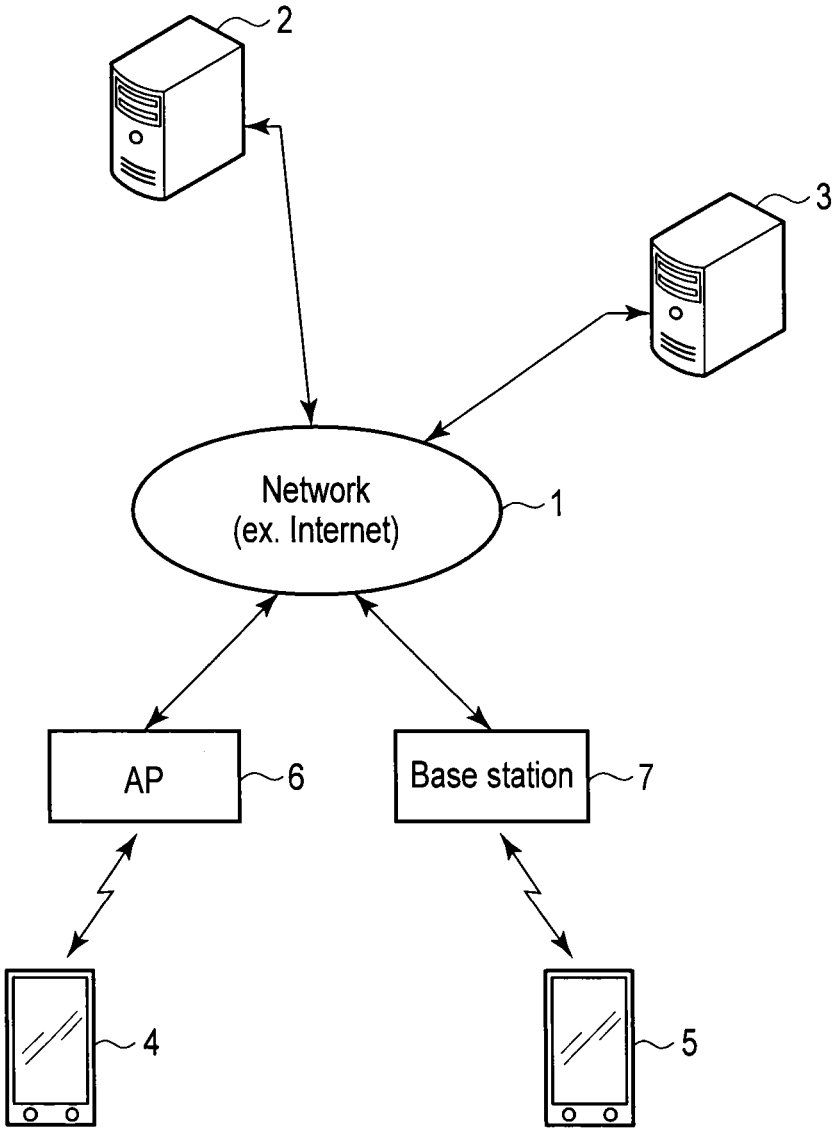
FIG. 1 is a view for explaining an example of an environment in which an on-line game system according to an embodiment of the present invention is used.

FIG. 1 is a view for explaining an example of an environment in which the on-line game system according to this embodiment is used. Referring to FIG. 1, web server apparatuses 2 and 3 are connected to a network 1 including the Internet. Portable terminals 4 and 5 serving as client apparatuses used by users in this system are connected to the network 1 via an AP (Access Point) 6 or base station 7.

The web server apparatuses 2 and 3 are computers to implement the on-line game system according to this embodiment. A plurality of web server apparatuses are parallelly provided in the network 1 which provides the on-line game service.

The portable terminals 4 and 5 on the client side include smartphones and feature phones, and may be, for example, portable phones running on an OS, such as Android® or iOS®. Alternatively, the portable terminals 4 and 5 may be notebook personal computers, mobile computers, or tablet computers. In any case, according to this embodiment, a game program for an on-line game provided by the web server apparatuses 2 and 3 is installed in advance for the portable terminals 4 and 5.

The operation of the above embodiment will be described below.

Figure 2:
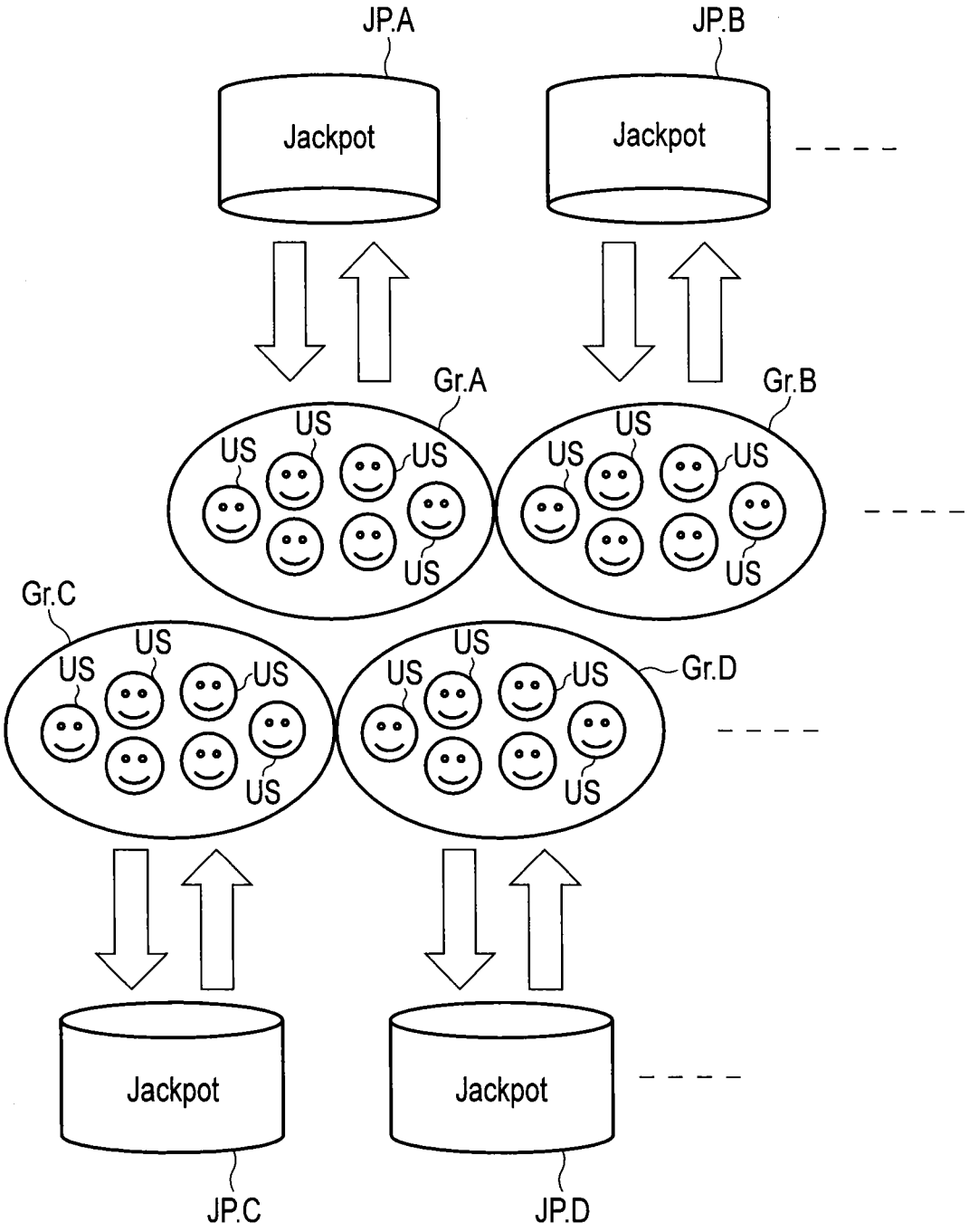
FIG. 2 is a view showing the concept of a game environment provided by a web server apparatus according to the above embodiment.

FIG. 2 shows the concept of a game environment provided by the web server apparatuses 2 and 3. As shown in FIG. 2, in this game system, a large number of users US operating the portable terminals 4 and 5 are divided into a plurality of groups Gr.A, Gr.B, . . . . Objects called jackpots JP.A, JP.B, . . . which collect and distribute resources are provided for the respective groups. The resources are exchanged in each group in accordance with user operations.

Note that if users constitute, for example, a team of acquaintances, they set the team at the time of acceptance registration, so that the users belonging to this team are assigned to the same group.

Figure 3:
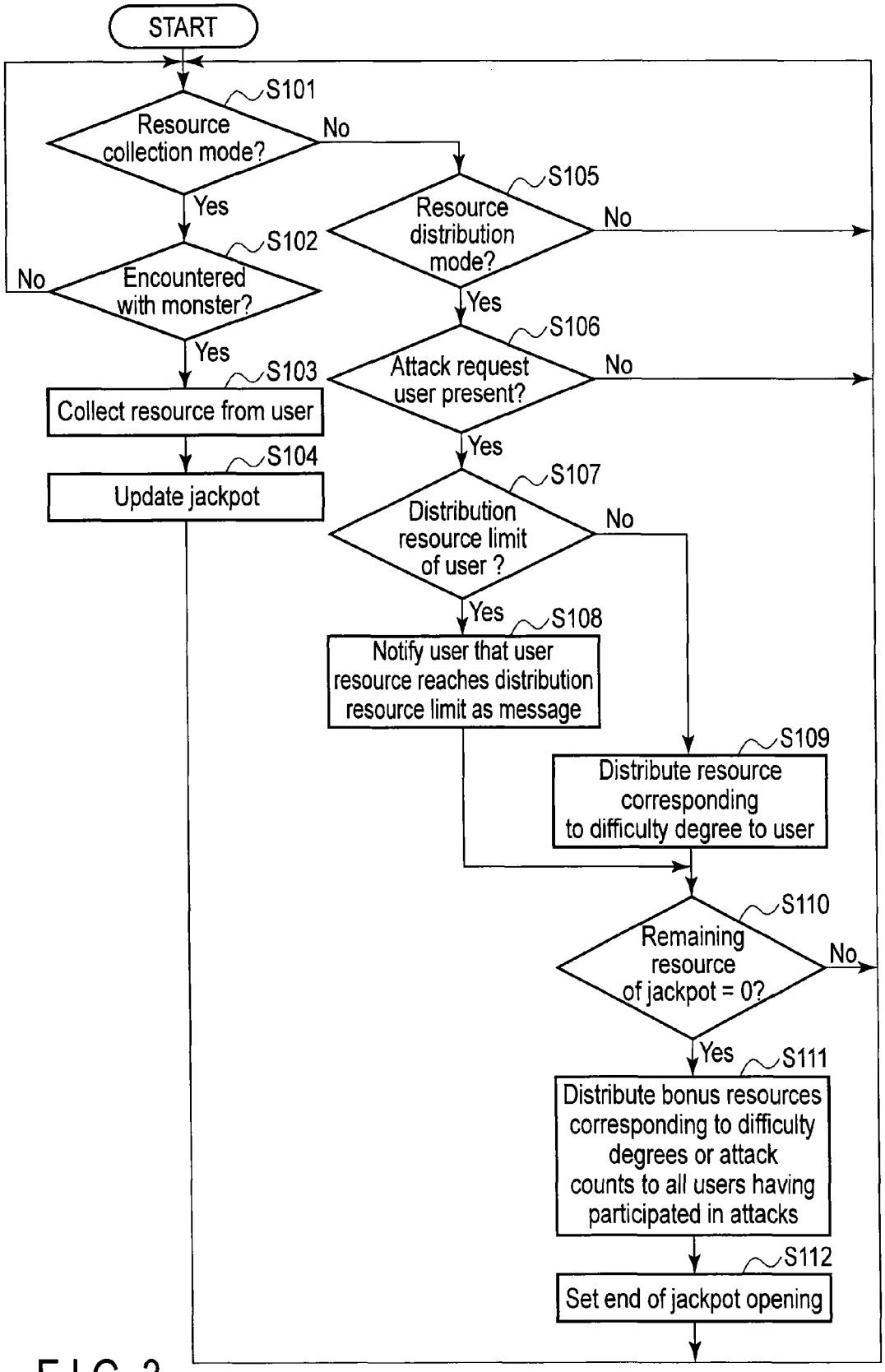
FIG. 3 is a flowchart showing the processing contents about the collection and distribution of resources, which are executed by the web server apparatus according to the above embodiment.

FIG. 3 is a flowchart showing the processing contents about the resource collection and distribution in one group executed by the web server apparatuses 2 and 3. In the following description, assume that the game program stored in the web server apparatus 2 according to this embodiment is executed.

In a game to be described below, the user of each terminal has two types of resources, that is, an energy value (E value) and a money value (M value). The jackpot collects and distributes these resources to progress the game.

The energy value (E value) is a resource which may be called an HP (Hit Point), health point, or life in general games to allow a character (or an avatar) operated by the user to behave in the game. On the other hand, the money value (M value) is a resource indicating an intra-game virtual currency, coins, and points required to purchase various kinds of items and the like in the game.

The game program of the web server apparatus 2 determines in the initial stage of processing whether a mode for collecting and accumulating a resource (to be referred to as a "resource collection mode") as one of the two modes is set (step S101).

If the resource collection mode is determined, the web server apparatus 2 determines whether the character operated by the user in the game space encounters a monster serving as a resource collection object (step S102).

If the web server apparatus 2 determines in step S102 that the character operated by the user does not encounter the monster in the game space, the process returns to processing in step S101, and the same processing as described above is repeated.

If the web server apparatus 2 determines in step S102 that the character operated by the user encounters the monster in the game space in the resource collection mode, the game program of the web server apparatus 2 collects part of the resource of the character and accumulates it in the jackpot (step S103). The game program then updates and sets the resource amount in the jackpot by the accumulation amount (step S104) and returns to processing from step S101 again.

Figure 4A:
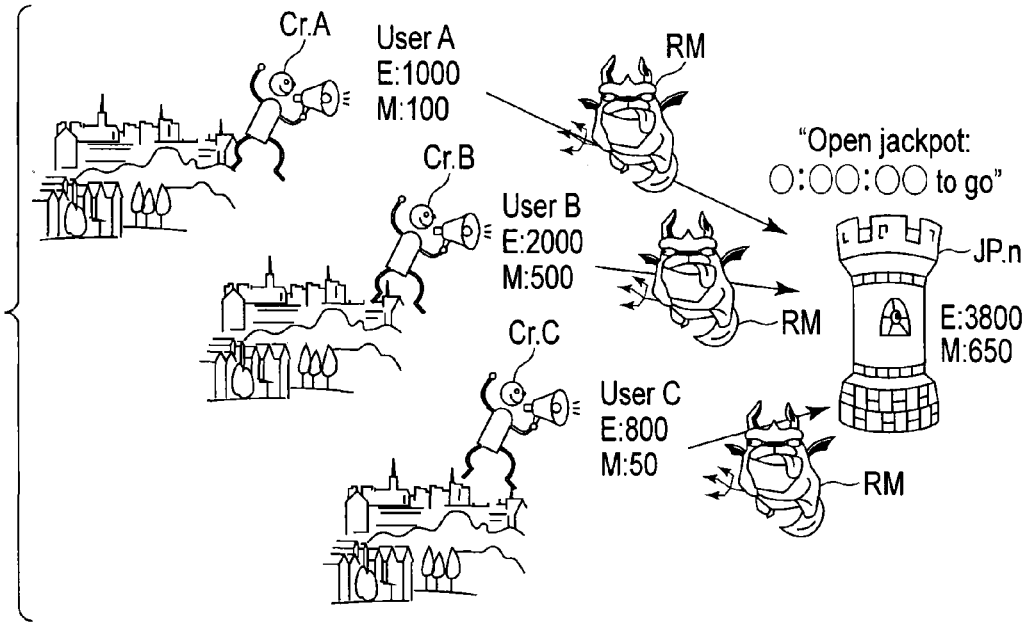
FIG. 4A is a view showing the concept of a resource flow in a resource collection mode and resource distribution mode according to the above embodiment.

FIG. 4A shows the concept of a resource flow in the resource collection mode. In this case, a state in which characters Cr.A to Cr.C operated by users A to C encounter monsters RM, respectively, and the resources are forcibly collected is illustrated.

At this time, the monster RM collects an energy value of "1,000" and a money value of "100" from the character Cr.A operated by the user A. These collected values are accumulated in a jackpot JP.n.

Similarly, the monster RM collects an energy value of "2,000" and a money value of "500" from the character Cr.B operated by the user B. These collected values are accumulated in the jackpot JP.n.

In addition, the monster RM collects an energy value of "800" and a money value of "50" from the character Cr.C operated by the user C. These collected values are accumulated in the jackpot JP.n.

An energy value of "3,800" and a money value of "650" are accumulated in the jackpot JP.n by only the resources collected from the above three characters.

Note that in the resource collection mode, a time until the end of the resource collection mode may be counted down as "open (jackpot) ○:○○:○○ to go" together with the image of the jackpot JP.n in the image of the game space displayed on the portable terminal 4 or 5. A time during which the characters operated by the users escape not to encounter the monsters RM in the game space may be guided and displayed.

A specific value of a resource collected by the monster RM upon encountering with a character may be set as a random value every time using a predetermined ratio as the upper limit in accordance with, for example, a resource value held by each character at that time. Alternatively, this specific value may be changed by setting the types of monsters RM and the like.

During the period of resource collection mode, the processing of steps S101 to S104 as described above is repeated.

At the end of the resource collection mode, when the web server apparatus 2 determines in step S101 that the current mode is not the resource collection mode, the web server apparatus 2 determines whether a mode for releasing the resources accumulated in the jackpot JP.n and distributing them (to be referred to the "resource distribution mode" hereinafter) is set (step S105).

When the web server apparatus 2 determines that the current mode is the resource distribution mode, the web server apparatus 2 then determines whether a character operated by a user attacks the jackpot JP.n (step S106).

If no attack from the user side is determined, the game program of the web server apparatus 2 returns to processing from step S101. In the resource distribution mode, processing in steps S101, S105, and S106 is repeated, and the program waits for an attack from the user side.

In step S106, if an attack from the user side is determined in the resource distribution mode, the game program of the web server apparatus 2 determines whether the resource value of the user who has attacked has already reached a limit value for distributing a resource in the resource distribution mode at this time (step S107). This limit value is based on difficulty degree selection by the user, and a detailed description thereof will be made later.

In step S107, when the value of the resource to be distributed to the user in the resource distribution mode has not reached the limit value, the game program of the web server apparatus 2 distributes a resource by a predetermined amount each time determined by the difficulty degree preselected by the character on the user side (step S109).

Figure 4B:
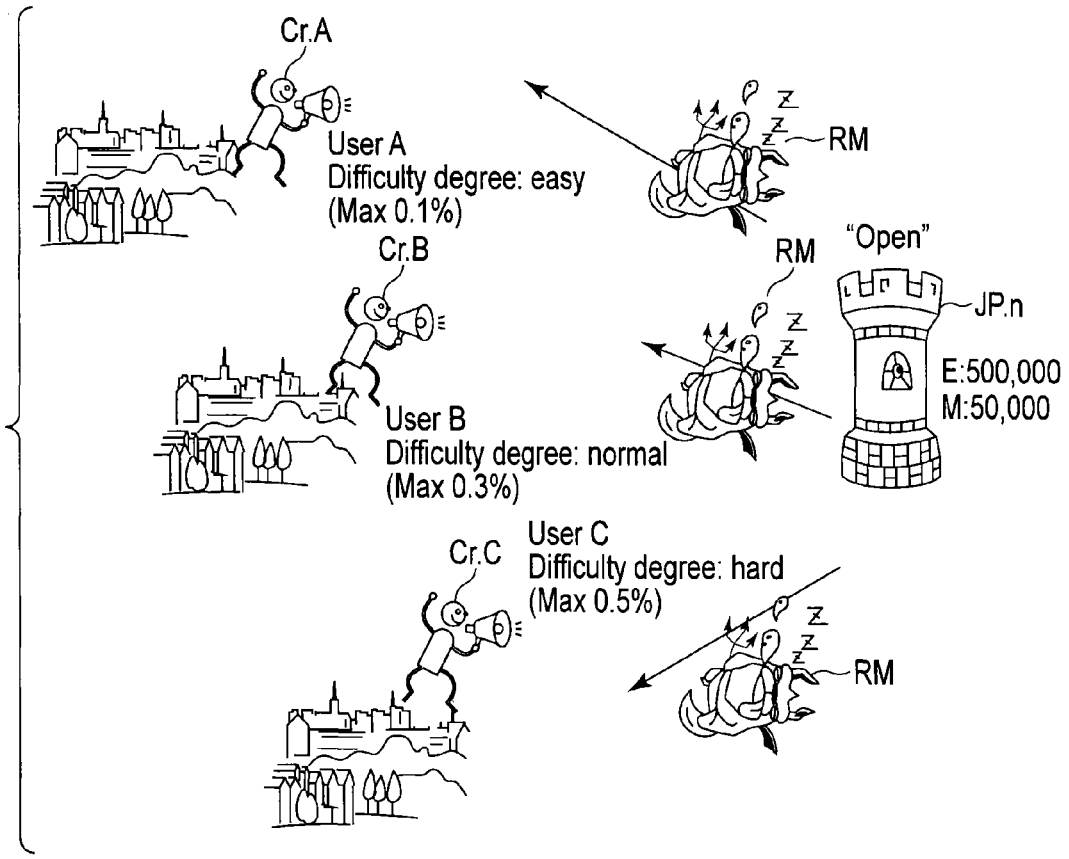
FIG. 4B is a view showing the concept of another resource flow in the resource collection mode and resource distribution mode according to the above embodiment.

FIG. 4B shows the concept of the resource flow in the resource distribution mode. FIG. 4B illustrates a state in which the characters Cr.A to Cr.C operated by the users A to C attack the jackpot JP.n and receive the resources while the characters stay away from the nonresistive sleeping monsters RM.

The ON resource distribution mode is displayed like "open" together with the image of the jackpot JP.n in the image of the game space displayed on the portable terminal 4 or 5. In this manner, this makes it possible to guide and display reception upon the release and distribution of the resources accumulated in the jackpot JP.n without attacks of the monsters RM on the characters operated by the users in the game space.

Note that each user preselects one of difficulty degrees, that is, "easy", "normal", and "hard" for a character operated by a user at the start of the game, so that the respective users receive different resource amounts distributed from the jackpot JP.n in accordance with the difficulty degrees.

This difficulty degree settings may influence a probability of escape from the monster RM in the resource collection mode and processing about other game events although these events are not described here.

When the difficulty degree of the character Cr.A operated by the user A is set as "easy" in advance, a resource will be distributed at a maximum of "0.1%" of the resources accumulated in the jackpot JP.n at the start of the resource distribution mode.

When the difficulty degree of the character Cr.B operated by the user B is set as "normal" in advance, a resource will be distributed at a maximum of "0.3%" of the resources accumulated in the jackpot JP.n at the start of the resource distribution mode.

When the difficulty degree of the character Cr.C operated by the user C is set as "hard" in advance, a resource will be distributed at a maximum of "0.5%" of the resources accumulated in the jackpot JP.n at the start of the resource distribution mode.

The resources distributed from the jackpot JP.n to these three characters per once are different in accordance with the difficulty degrees. The resources distributed from the jackpot JP.n to these three characters have different limit values in accordance with the difficulty degrees as described above.

When the game program of the web server apparatus 2 determines in step S107 that the resource value of the user who has attacked has already reached the limit value in the resource distribution mode, the game program notifies this user that the resource value has already reached the distribution limit value according to the difficulty degree as a guide message (step S108).

After the game program notifies the user that the resource has already reached the limit value in step S108, or distributes a resource against the attack in step S109, the game program of the web server apparatus 2 determines whether the remaining resources in the jackpot JP.n reach "0 (zero)" (step S110).

When the game program determines that the resources remain in the jackpot JP.n and are not "0 (zero)", the game program of the web server apparatus 2 returns to processing from step S101 to continue the same processing described above.

For example, when the mode time set in advance has elapsed and the resource distribution mode ends before the resources in the jackpot JP.n reach "0 (zero)", the game program of the web server apparatus 2 determines in step S105 that the resource distribution mode ends and returns to processing in step S101. The mode shifts to the operation of the next resource collection mode.

When the game program determines in step S110 that the resources in the jackpot JP.n reach "0 (zero)" in the resource distribution mode, the web server apparatus 2 distributes bonus resources to the characters operated by all the users having participated in the attacks on the jackpot JP.n by values corresponding to the selected difficulty degrees or attack counts (step S111).

The bonus values to be distributed in this case also change in accordance with the attack counts. For this reason, users whose resource values have already reached the limit values begin to continuously attack the jackpot JP.n as well to obtain larger bonus values until the remaining resources in the jackpot JP.n is determined by the game program to have reached "0 (zero)". Thus, the users are able to have feeling that they attack on the jackpot JP.n as a team.

The game program of the web server apparatus 2 then sets to terminate the resource distribution mode regardless of the resource distribution mode time elapsed at that time (step S112). The game program returns to processing in step S101 and shifts to the operation of the next resource collection mode.

HP (Hit Point) different from the resources may be set in the jackpot JP.n. Every time a user attack is determined, the HP value may be decreased by predetermined value.

A case in which such setting is made will also be described as an example of partially modifying the flowchart of FIG. 3.

Figure 5:
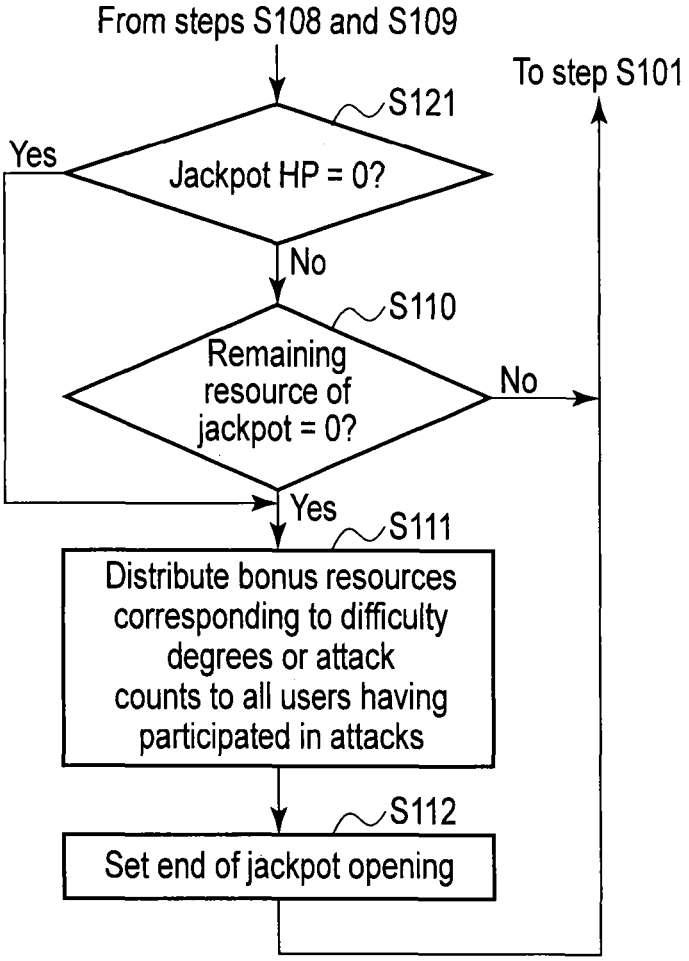
FIG. 5 is a flowchart showing a partial modification of FIG. 3 according to the above embodiment.

FIG. 5 shows this modification. After processing in step S108 or S109, the game program determines whether the HP (Hit Point) of the jackpot JP.n which decreases upon reception of attacks reaches "0 (zero)" (step S121).

If the game program determines that the HP (Hit Point) of the jackpot JP.n does not reach "0 (zero)", the process advances to step S110 to determine whether the remaining resources of the jackpot JP.n reach "0 (zero)".

If the game program determines in step S121 that the HP (Hit Point) of the jackpot JP.n reaches "0 (zero)", the process advances to step S111 regardless of whether the resources of the jackpot JP.n remain. In step S111, the bonus resources may be distributed.

With the above setting, the users participating in the attacks cooperate with each other as a team to obtain bonuses and repeatedly and continuously attack the jackpot JP.n to decrease the HP (Hit Point).

As has been described above, according to this embodiment, the degree of entertainment can be enhanced in the process of circulating the resources in the strategy simulation games and the like.

The switching time between the resource collection mode and the resource distribution mode may be set in advance. Mode switching may be performed based on the total amount of moved resources even within the set time. Mode switching may be performed in accordance with a user operation. This makes it possible to enhance interaction in the game.

In the above embodiments, a character which can obtain a higher degree of resource distribution although it is readily attacked by the monster RM or a character which can obtain a lower degree of resource distribution although it can readily avoid the attack from the monster can be set by controlling return rate when the resources are distributed, etc, in accordance with the selected difficulty degree in advance. Thus, it can be possible to provide a game apparatus having a higher degree of entertainment according to a user preference.

In the above embodiment, bonus resources are distributed to characters operated by all the users having participated in the attacks when the resources of the jackpot JP.n do not remain. When many characters belong to a given group cooperate and participate in attacks, an opportunity of receiving the distributed resources increases. For this reason, active user participation in the game is promoted to highly activate the game environment.

As shown in FIG. 2 above, a large number of users can be divided into a plurality of groups to control the games for independent jackpots in the respective groups. Even if the number of users increases, processing loads can be distributed to the web server apparatuses 2 and 3.

In the above embodiment, an object for collecting and accumulating the resources is substantiated in the form of the jackpot JP.n, and an object for directly collecting the resource upon the attack on the user is substantiated in the form of the monster RM, as shown in FIGS. 4A and 4B. However, types of resources and the forms of the various kinds of objects are not limited to these. According to the present invention, images of various kinds of objects and resource parameters can be freely set in accordance with a game environment to be provided, as a matter of course.

The present invention is not limited to the embodiment described above, and can be variously modified without departing from the scope of the present invention in practical stages. The functions executed by the embodiment described above can be appropriately combined as much as possible and practiced. The embodiment described above incorporates various kinds of stages, and various kinds of inventions can be extracted by appropriate combinations of the plurality of disclosed constituent elements. For example, even if some constituent elements are deleted from all the constituent elements disclosed in the embodiment, an arrangement from which some constituent elements are deleted can be extracted as an invention if an effect can be obtained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A system for providing a game which accompanies a resource increasing or decreasing in a game space to a plurality of terminal apparatuses via a communication network, comprising:

circuitry configured to determine whether game characters operated by users of the plurality of terminal apparatuses encounter a first game object in the game space in a resource collection mode;

when the game characters encounter the first game object in the game space in the resource collection mode, collect a plurality of resources from the game characters and accumulate the collected plurality of resources in association with the first game object, the plurality of resources including at least one of an energy value and a money value for each of the game characters;

determine whether a game character operated by a user of a first terminal apparatus of the plurality of terminal apparatuses attacks a second game object in a resource distribution mode;

when the game character operated by the user of the first terminal apparatus attacks the second game object in the resource distribution mode, distribute an amount of the accumulated plurality of resources to the first terminal apparatus in accordance with a difficulty degree in compliance with a selection of the user of the first terminal apparatus when the amount of the accumulated plurality of resources to be distributed to the first terminal apparatus does not reach a limit for the first terminal apparatus, the limit being predetermined in accordance with the difficulty degree; and selectively switch between the resource collection mode and the resource distribution mode.

2. The system according to claim 1, wherein the circuitry is configured to switch between the resource collection mode and the resource distribution mode in accordance with at least one of preset time and a preset resource amount of the accumulated plurality of resources.

3. The system according to claim 1, wherein the circuitry is configured to:

switch between the resource collection mode and the resource distribution mode in accordance with a preset time; and notify the each of the plurality of terminal apparatuses to display a time to switch between the resource collection mode and the resource distribution mode.

4. The system according to claim 1, wherein the circuitry is configured to distribute via the communication network bonus resources to all terminal apparatuses which have attacked the second game object when the amount of the plurality of resources to be distributed reaches zero.

5. The system according to claim 1, wherein the first game object collects and accumulates the plurality of resources from the first terminal apparatus.

6. The system according to claim 1, wherein the circuitry is configured to set a plurality of groups and independently control the collecting of the plurality of resources, the distributing of the accumulated plurality of resources, and the switching between the resource collection and resource distribution modes between each of the plurality of groups, the plurality of terminal apparatuses belonging to the each of the plurality of groups.

7. The system according to claim 1, wherein the system is a server.

8. The system according to claim 1, wherein the system comprises a plurality of servers.

9. The system according to claim 1, further comprising:

a communication interface configured to communicate with the plurality of terminal apparatuses via the communication network.

10. The system according to claim 1, wherein the circuitry comprises a processor and a memory that includes program instructions, and the processor is configured to access the memory and execute the instructions.

11. The system according to claim 1, further comprising:

a communication interface configured to communicate with the plurality of terminal apparatuses via the communication network, wherein the circuitry is configured to generate a user interface corresponding to the game space and control the communication interface to transmit the generated user interface to each of the plurality of terminal apparatuses via the communication network.

12. The system according to claim 1, wherein the first game object collects and accumulates the plurality of resources from the first terminal apparatus, and the circuitry is further configured to update and store the collected plurality of resources in a storage of the system when the game characters encounter the first game object in the game space in the resource collection mode.

13. The system according to claim 1, wherein the circuitry is further configured to:

determine whether the amount of the plurality of resources to be distributed to the first terminal apparatus reaches the limit for the first terminal apparatus when the game character operated by the user of the first terminal apparatus attacks the second game object;

and update and store remaining of the plurality of resources in a storage of the system when the game character operated by the user of the first terminal apparatus attacks the second game object in the resource distribution mode.

14. The system according to claim 1, wherein the energy value corresponds to a parameter that allows each character operated by each user of the plurality of terminal apparatuses to play the game, and the money value corresponds to a virtual currency that allows the each user of the plurality of terminal apparatuses to purchase various kinds of game items for the game.

15. A game control method performed by a system for providing a game which accompanies a resource increasing or decreasing in a game space to a plurality of terminal apparatuses via a communication network, the method comprising:

determining whether game characters operated by users of the plurality of terminal apparatuses encounter a first game object in the game space in a resource collection mode;

when the game characters encounter the first game object in the game space in the resource collection mode, collecting a plurality of resources from the game characters and accumulating the collected plurality of resources in association with the first game object, the plurality of resources including at least one of an energy value and a money value for each of the game characters;

determining whether a game character operated by a user of a first terminal apparatus of the plurality of terminal apparatuses attacks a second game object in a resource distribution mode;

when the game character operated by the user of the first terminal apparatus attacks the second game object in the resource distribution mode, distributing an amount of the accumulated plurality of resources to the first terminal apparatus in accordance with a difficulty degree in compliance with a selection of the user of the first terminal apparatus when the amount of the accumulated plurality of resources to be distributed to the first terminal apparatus does not reach a limit for the first terminal apparatus, the limit being predetermined in accordance with the difficulty degree; and selectively switching between the resource collection mode and the resource distribution mode.

16. The game control method according to claim 15, wherein the energy value corresponds to a parameter that allows each character operated by each user of the plurality of terminal apparatuses to play the game, and the money value corresponds to a virtual currency that allows the each user of the plurality of terminal apparatuses to purchase various kinds of game items for the game.

17. A non-transitory computer-readable medium including computer program instructions, which when executed by an electronic server device connected to a plurality of terminal apparatuses via a communication network, cause the electronic server device to:

determine whether game characters operated by users of the plurality of terminal apparatuses encounter a first game object in the game space in a resource collection mode;

when the game characters encounter the first game object in the game space in the resource collection mode, collect a plurality of resources from the game characters and accumulate the collected plurality of resources in association with the first game object, the plurality of resources including at least one of an energy value and a money value for each of the plurality of terminal apparatuses;

determine whether a game character operated by a user of a first terminal apparatus of the plurality of terminal apparatuses attacks a second game object in a resource distribution mode;

when the game character operated by the user of the first terminal apparatus attacks the second game object in the resource distribution mode, distribute an amount of the accumulated plurality of resources to the first terminal apparatus in accordance with a difficulty degree in compliance with a selection of the user of the first terminal apparatus when the amount of the accumulated plurality of resources to be distributed to the first terminal apparatus does not reach a limit for the first terminal apparatus, the limit being predetermined in accordance with the difficulty degree; and selectively switch between the resource collection mode and the resource distribution mode.

18. The non-transitory computer-readable medium including computer program instructions according to claim 17, wherein the energy value corresponds to a parameter that allows each character operated by each user of the plurality of terminal apparatuses to play the game, and the money value corresponds to a virtual currency that allows the each user of the plurality of terminal apparatuses to purchase various kinds of game items for the game.

* * * * *